US005375421A

United States Patent [19]

Hsieh

[11] Patent Number: 5,375,421

[45] Date of Patent: Dec. 27, 1994

[54] PORTABLE THERMOELECTRIC DEHUMIDIFIER

[76] Inventor: Chi-Sheng Hsieh, c/o Hung Hsing Patent Service Center P.O. Box 55-1670, Taipei (104), Taiwan, Prov. of China

[21] Appl. No.: 161,548

[22] Filed: Dec. 6, 1993

[51] Int. Cl.[5] ..... F24F 1/00

[52] U.S. Cl. ..... 62/3.4

[58] Field of Search ..... 62/3.4, 3.2, 3.6, 3.62, 62/272

[56] References Cited

U.S. PATENT DOCUMENTS

| | | | |
|---|---|---|---|
| 3,050,948 | 8/1962 | Jones | 62/3.4 |
| 3,126,710 | 3/1964 | Boehmer et al. | 62/3.4 |
| 5,119,640 | 6/1992 | Conrad | 62/272 |
| 5,237,821 | 8/1993 | Okumura et al. | 62/3.2 |
| 5,279,128 | 1/1994 | Tomatsu et al. | 62/3.4 |

FOREIGN PATENT DOCUMENTS

| | | | |
|---|---|---|---|
| 73038 | 4/1988 | Japan | 62/3.4 |
| 184343 | 7/1989 | Japan | 62/3.4 |

*Primary Examiner*—Henry A. Bennet
*Assistant Examiner*—William C. Doerrler

[57] ABSTRACT

A portable dehumidifier includes: a housing having an upper housing portion and a base portion positioned below the upper housing portion, at least a thermoelectric cooler formed as thermopile by connecting in series one plurality of thermocouples each thermocouple consisting of a p-type semiconductor and a n-type semiconductor electrically connected between two poles of a direct-current power supply to produce a cold junction and a hot junction on a front and a rear sides of the thermoelectric cooler, a heat-dissipating device secured to a hot junction of the thermoelectric cooler for dissipating heat from the hot junction, an exhausting fan for drawing moisture-laden air through the thermoelectric cooler and the heat-dissipating device to condense moisture laden in the air by the cooler, a condensate collector having a water-reservoir drawer slidably held in the base portion to collect the water drops drained from the cooler for disposal of the condensed water from the air, and a timing controller for sequentially alternately switching on and off the power supply to the cooler, whereby upon powering of the thermoelectric cooler, the moisture laden in the air will be condensed, frosted or frozen on the cold junction, while upon switching off of the power supply to the cooler, the cold junction of the cooler will become warmer to drain the condensed water to be collected in the condensate collector.

2 Claims, 4 Drawing Sheets

PORTABLE THERMOELECTRIC DEHUMIDIFIER

BACKGROUND OF THE INVENTION

A conventional electrical room dehumidifier operates on a same refrigeration principle, in that, moisture-laden air is generally drawn into the rear of the dehumidifier and over the cold evaporator coils by the fan. The moisture is condensed and deposited on the coils of the dehumidifier when the air is cooled and the water thus condensed will fall into a water container or is drained outwardly. However, such a conventional room dehumidifier may have the following drawbacks:

1. Ambient air will condense on a refrigerant evaporator of the room dehumidifier, in which a system is required to evaporate the refrigerant and to condense the refrigerant, causing a big space, heavy weight and noise pollution for the installation and operation of such a conventional dehumidifier.
2. Cost will be higher to purchase, operate and maintain the conventional dehumidifier.
3. For dehumidifying an interior of a tiny space such as in a cabinet, bookcase, wardrobe, or instrument room, a conventional larger dehumidifier will not be applicable.

SUMMARY OF THE INVENTION

The object of the present invention is to provide a portable dehumidifier including: a housing having an upper housing portion and a base portion positioned below the upper housing portion, at least one thermoelectric cooler formed as thermopile by connecting in series a plurality of thermocouples each thermocouple consisting of a p-type semiconductor and a n-type semiconductor electrically connected between two poles of a direct-current power supply to produce a cold junction and a hot junction on a front and a rear sides of the thermoelectric cooler, a heat-dissipating device secured to a hot junction of the thermoelectric cooler for dissipating heat from the hot junction, an exhausting fan for drawing moisture-laden air through the thermoelectric cooler and the heat-dissipating device to condense moisture laden in the air by the cooler, a condensate collector having a water-reservoir drawer slidably held in the base portion to collect the water drops drained from the cooler for disposal of the condensed water from the air, and a timing controller for sequentially alternately switching on and off the power supply to the cooler, whereby upon powering of the thermoelectric cooler, the moisture laden in the air will be condensed, frosted or frozen on the cold junction, while upon switching off of the power supply to the cooler, the cold junction of the cooler will become warmer as heated by the heat conducted from the hot junction plate to melt the frost or ice to be water drops which are then drained and collected in the condensate collector.

DETAILED DESCRIPTION

Figure 1:
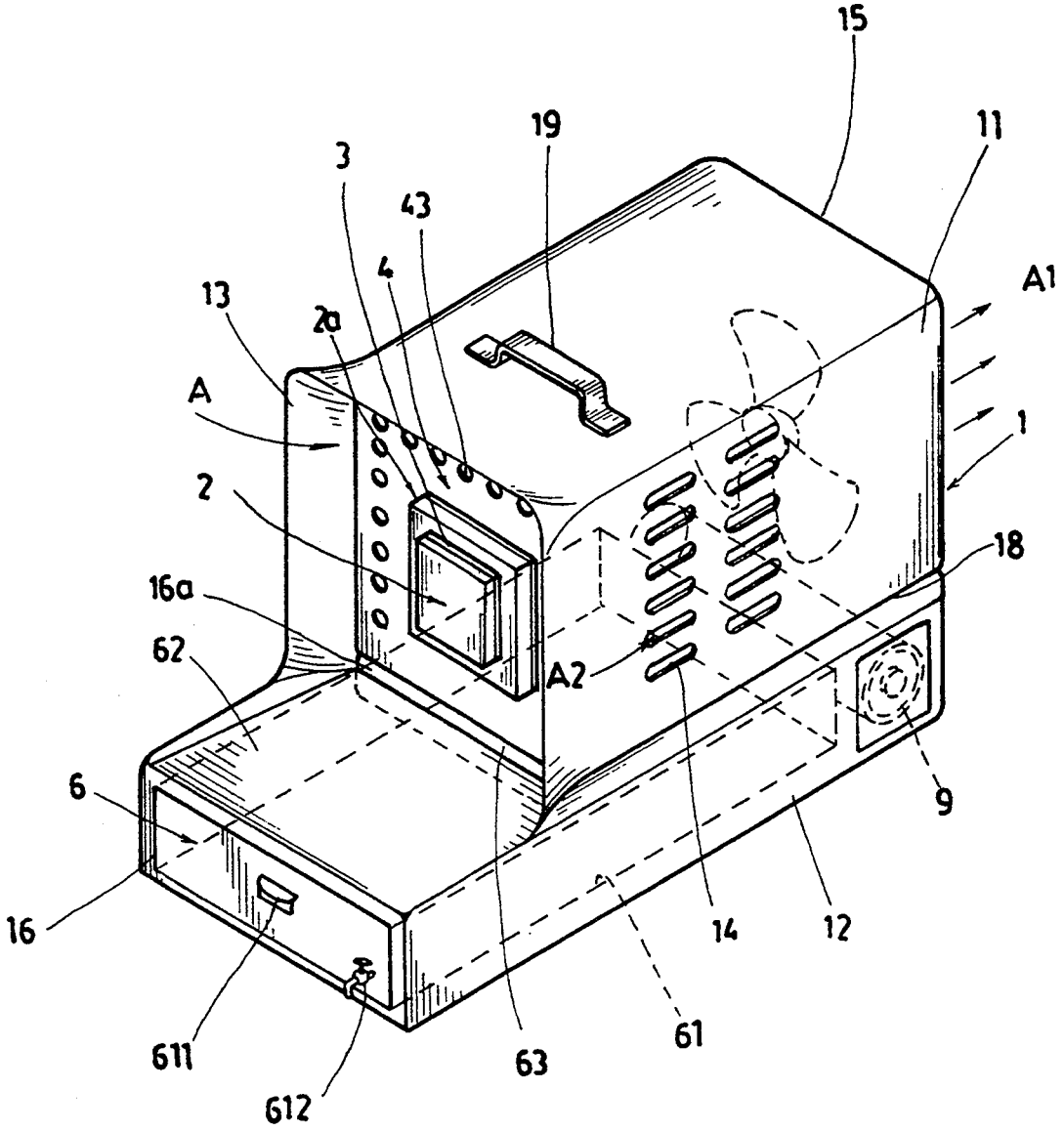
FIG. 1 is a perspective view of the present invention.

As shown in the drawing figures, the present invention comprises: a housing 1, at least one thermoelectric cooler 2 secured to a heat-dissipating means 4 by a heat-conductive layer 3, an exhausting fan 5, a condensate collector 6, a timing controller 7, a temperature controller 8, and a power supply 9.

Figure 2:
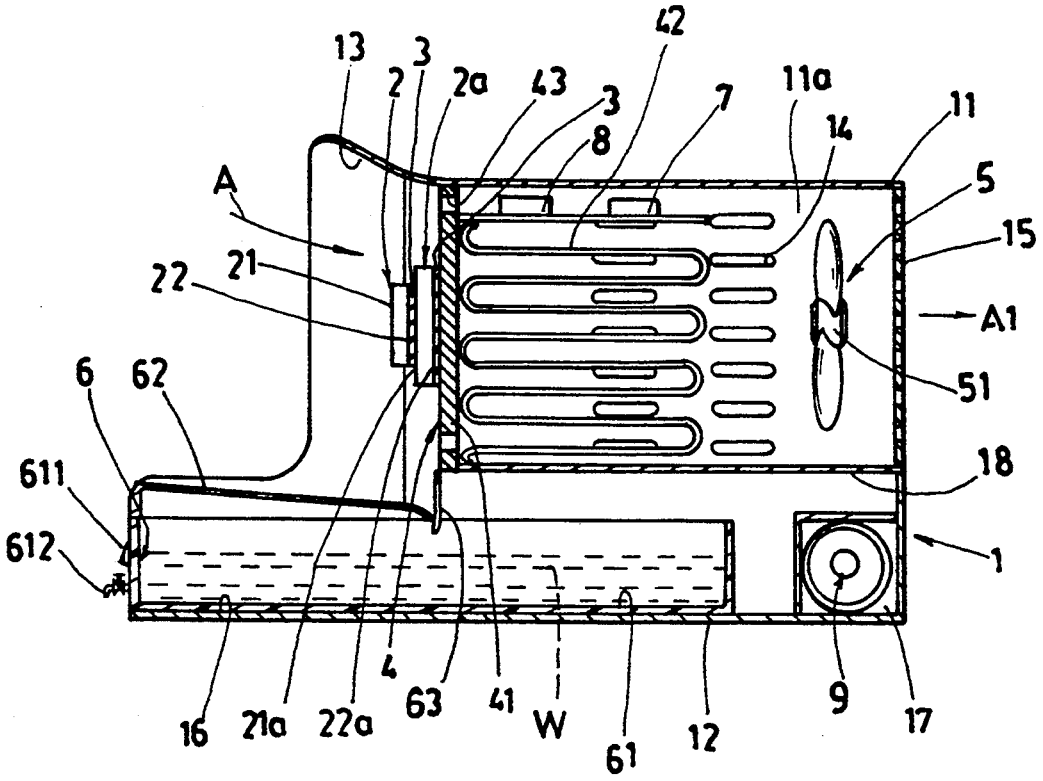
FIG. 2 is a sectional drawing of the present invention.

The number of the thermoelectric cooler 2 of the present invention is not limited. As shown in FIGS. 1, 2, there may be provided with two thermoelectric coolers 2, **2*a* connected in series. For example, the front cooler 2 may have a front surface area of 30 mm×33 mm, and the rear cooler 2*a*** may have a front surface area of 40 mm×40 mm.

The housing 1 includes: an upper housing portion 11, a base portion 12 positioned below the upper housing portion 11, a suction hood 13 formed on a front portion of the upper housing portion 11 for directing moisture-laden air rearwardly into the upper housing portion 11 and for storing the thermoelectric cooler 2 in the hood 13, a plurality of venting slots 14 notched in an intermediate portion of the upper housing portion 11 for drafting air inwardly into a rear chamber **11*a* formed in a rear portion of the upper housing portion 11 with the rear chamber 11*a* provided for storing the heat-dissipating means 4 and the exhausting fan 5 in the rear chamber 11*a*, a rear screen 15 mounted in a rear end portion of the upper housing portion 11, a bottom socket 16 formed in the base portion 12 for slidably holding the collector 6 in the socket 16, a battery chamber 17 formed in the base portion 12 for storing batteries of the power supply 9 which may be rechargeable batteries, a partition plate 18 horizontally separating the upper housing portion 11 and the base portion 12, and a handle 19 secured to a top portion of the upper housing portion 11** for portable use.

Figure 4:
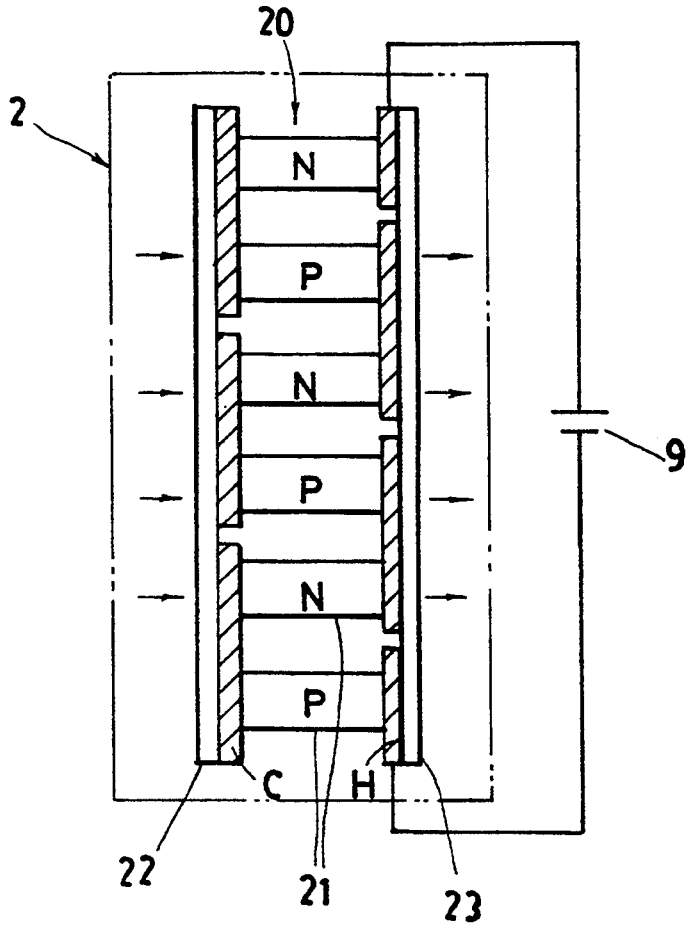
FIG. 4 is an illustration of the present invention showing construction of the thermoelectric cooler by p-type and n-type semiconductors.

Each thermoelectric cooler 2 as shown in FIGS. 2 and 4 includes: a plurality of thermocouples 21 connected in series to form a thermopile 20 each thermocouple 21 consisting of a p-type semiconductor P and a n-type semiconductor N electrically connected in series and connected between a negative pole and a positive pole of a direct-current power supply 9 which may be supplied by batteries or direct-current (DC) power transformed and rectified from an alternative current (AC) power source, a cold junction plate 22 formed at a front surface portion of the cooler 2 and adhered to a cold junction C of the thermopile 20 for absorbing heat from a moisture-laden air A directed inwardly into the suction hood 13 as drafted by the exhausting fan 5 powered by the power supply 9, and a hot junction plate 23 formed at a rear surface portion of the cooler 2 and adhered to a hot junction H of the thermopile 20 for giving off heat from the hot junction plate 23. The hot junction plate 23 is secured to the heat-dissipating means 4 by a heat-conductive layer 4 made of thermally conductive materials.

As shown in FIGS. 1, 2, two thermoelectric coolers 2, **2*a* are connected in series in the upper housing portion 11, including: a first (or front) thermoelectric cooler 2 having a first cold junction plate 21 generally vertically formed at a cold junction of the first thermoelectric cooler 2 for absorbing heat from surroundings in front of the first cooler 2 for cooling the moisture-laden air A directed into the hood 13 for condensing the moisture in the air A on the front surface of the first cold-junction plate 21, and a first hot junction plate 23 formed at a hot junction of the first (or front) thermoelectric cooler 2 secured to a second cold junction plate 21***a* formed at a cold junction of a second (or rear) thermoelectric cooler 2*a* by a heat-conductive layer 3 which may be an adhesive, a paste or a connector made of electrically conductive materials; and the second (rear) thermoelectric cooler 2*a* having the second cold junction plate 21*a* operatively absorbing heat from that dissipated from the first hot junction plate 23 of the first thermoelectric cooler 2, and having a second hot junction plate 23*a* formed at a hot junction of the second thermoelectric cooler 2*a* secured to the heat-dissipating means 4 by the heat-conductive layer 3 for dissipating and transferring heat to the heat-dissipating means 4.

The heat-dissipating means 4 includes: a front thermally conductive panel 41 (which may be made of copper, aluminum or other suitable materials) generally vertically secured in the upper housing portion 11 between the suction hood 13 and the rear chamber 11*a*, the front conductive panel 41 secured to a hot junction plate 23 of the thermoelectric cooler 2 by a heat-conductive layer 3, a plurality of fins 42 secured to the front conductive panel 41 and protruding rearwardly in the rear chamber 11*a* to be in contact with an air stream entering the rear chamber through the plurality of venting slots 14 notched in the upper housing portion 11 for removing heat outwardly by heat exchange operation with the entered air stream A2 in the upper housing portion 11, in which the air stream A1 will be exhausted by the exhausting fan 5 which is driven by a DC driving motor 51, and a plurality of air passages 43 drilled in the front conductive panel 41 to direct air stream A rearwardly into the rear chamber 11*a* from the suction hood 13 through which the moisture-laden air A has been dehumidified as the moisture laden in the air A will be condensed, frosted or even frozen on the cold junction plate 21 and the water drops W condensed will be gravitationally drained downwardly to be collected by the condensate collector 6 positioned below the cooler 2.

Figure 3:
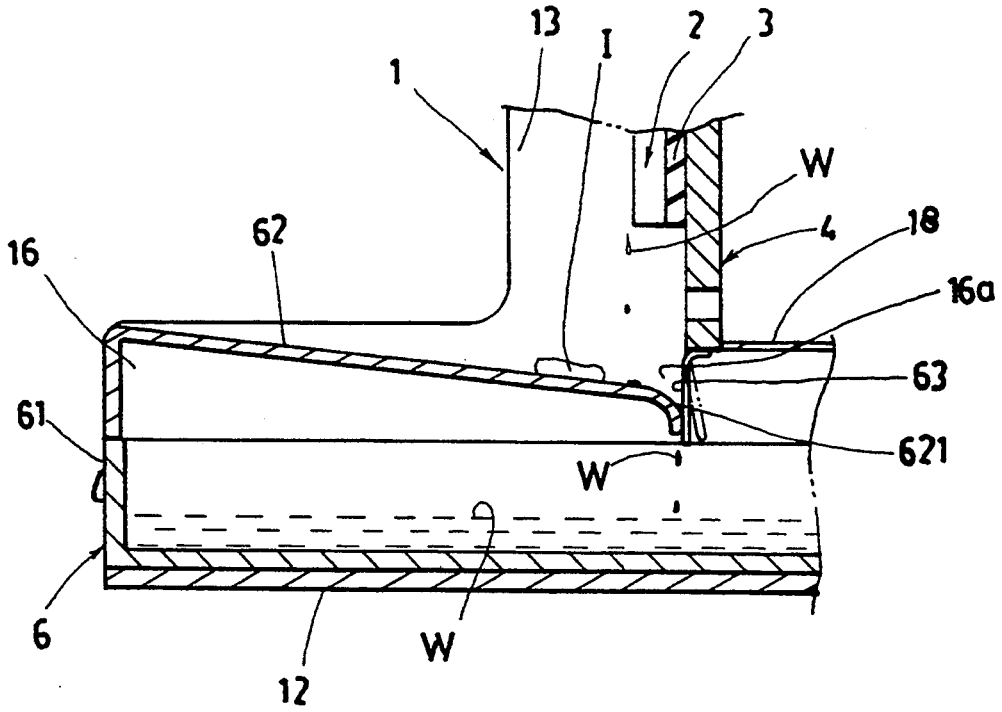
FIG. 3 is a partial illustration showing a drawing of condensed water from the thermoelectric cooler of the present invention.

The condensate collector 6 includes: a water-reservoir drawer 61 slidably held in the bottom socket 16 in the base portion 12 of the housing 1 for collecting the condensate water W drained from the thermoelectric cooler 2 or the water W melted from ice I dropping from the cooler 2 (FIG. 3), a drain chute 62 inclined downwardly rearwardly from a front end portion of the base portion 12 towards a drainage port 16*a* formed at a front edge portion of the partition plate 18 and in between a bottom edge portion of a front conductive panel 41 of the heat-dissipating means 4 and the water-reservoir drawer 61 for draining condensed water into the water-reservoir drawer 61 for disposal purpose, and a check valve 63 secured to a front end portion of the partition plate 18 for normally sealing the drainage port 16*a* for preventing evaporation of the condensed water W already collected in the drawer 61 and operatively opened for flowing the condensed water W from the chute 62 into the drawer 61.

Other designs of check valve 63 may be modified which are not limited in this invention.

The water-reservoir drawer 61 may be fixed with a grip 611 for withdrawing for decanting water from inside the drawer 611, and a drain valve 612 which may be connected with a hose or pipe (not shown) for discharging the water outwardly.

The check valve 63 may be a thin-layer flap made of elastomer materials for easy opening for draining condensed water and for resilient restoring for re-closing the port 16*a* at a rear end of the chute 62. Other check valve such as a solenoid valve may be chosen and modified in this invention.

Figure 5:
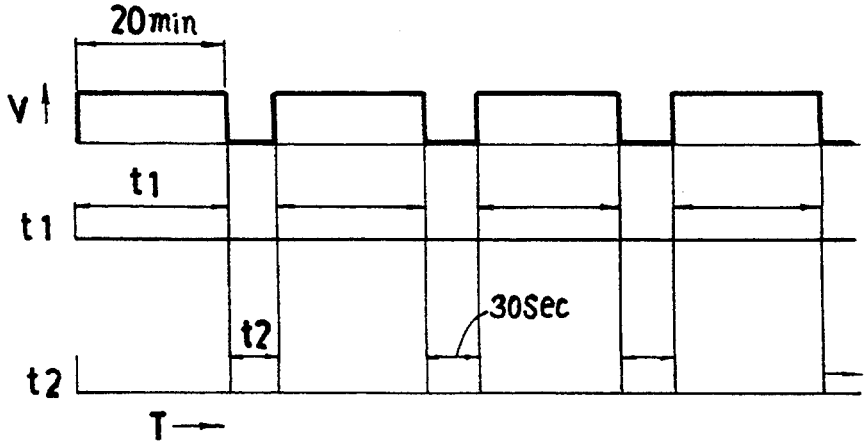
FIG. 5 shows a timing sequence of an on-off control of the thermoelectric cooler of the present invention.

The timing controller 7 includes: a timer switch sequentially alternately switching on and off a power supplied to the thermoelectric cooler 2 from the DC power supply 9 to alternately have a power-on time interval t1 and power-off time interval t2 following each power-on time interval t1 such as shown in FIG. 5, whereby during the power-on interval t1, the cooler 2 will be powered to absorb heat from the cold junction plate 21 to condense moisture laden in the air A or to frost or freeze the condensed water on the cold junction plate, and while during the power-off interval t2, the cooler 2 is disconnected from the power supply to stop its cooling and allow the hot junction plate to conduct heat towards the cold junction plate to warm the cold junction plate 21 to heat the frost or ice accumulated on the cold junction plate 21 to drain the water drops W gravitationally downwardly.

For example, a 555 timer integrated circuit (IC) may be provided for serving as the timing controller 7, in which a power-on interval t1 may be preset as 20 minutes and a power-off interval t2 be set as 30 seconds. FIG. 5 shows such a relationship by plotting output voltage V of the timer IC on the ordinate and a time lapse T on the abscissa.

The temperature controller 8 may be a thermostat which may be pre-set for a specific temperature, above which, the power supply 9 will be switched off to prevent a high rise of temperature due to unexpected heat produced at the hot junction side of the cooler 2, which is not well dissipated, thereby preventing a fire accident for safety purpose.

The present invention may be modified or changed without departing from the spirit and scope as claimed in this invention.

The present invention is superior to a conventional dehumidifier with the following advantages:

1. The volume of the dehumidifier can be greatly minimized by using the chip like thermoelectric cooler 2 to form a compact unit easily carried, and placed in any corner in a small space such as in a bookcase, a wardrobe, etc.
2. Installation, operation and maintenance cost can be greatly reduced since the construction of this invention is very simple.
3. Dehumidification can be efficiently achieved since even though a small area within a tiny interior can be placed with such a miniature portable dehumidifier.
4. Environmental protection may be well enhanced since no refrigerant is used in this unit, thereby neglecting the problem for reclaiming the refrigerant as found in a conventional dehumidifier.

Figure 6:
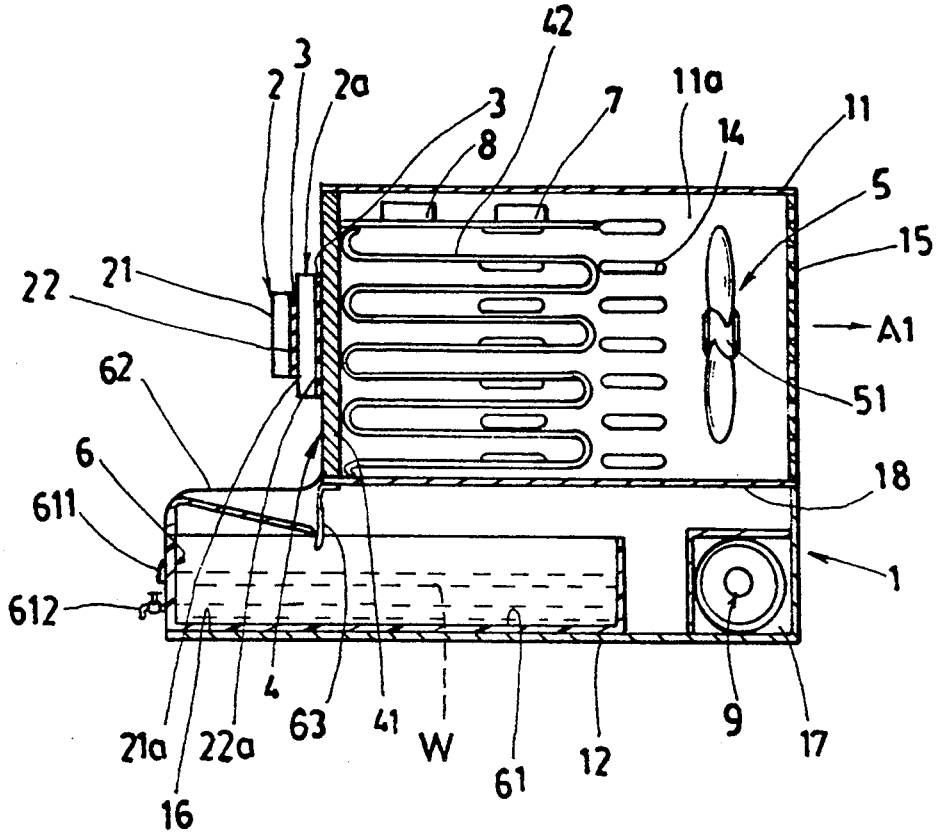
FIG. 6 shows another preferred embodiment of the present invention.

As shown in FIG. 6, the front conductive panel 41 is not drilled with the plural air passages 43 and the suction hood 13 is also eliminated to form a simplified structure to reduce its total volume to be suitably used in a very small space.

I claim:

1. A portable thermoelectric dehumidifier comprising:

a housing including: an upper housing portion, a base portion positioned below the upper housing portion, a suction hood formed on a front portion of the upper housing portion for directing moisture-laden air rearwardly into the upper housing portion and for storing the thermoelectric cooler in the hood, a plurality of venting slots notched in an intermediate portion of the upper housing portion for drafting air inwardly into a rear chamber formed in a rear portion of the upper housing portion with the rear chamber provided for storing the heat-dissipating means and the exhausting fan in the rear chamber, a rear screen mounted in a rear end portion of the upper housing portion, a bottom socket formed in the base portion for slidably holding the collector in the socket, a battery chamber formed in the base portion for storing batteries of the power supply, a partition plate horizontally separating the upper housing portion and the base portion, and a handle secured to a top portion of the upper housing portion for portable use;

at least one thermoelectric cooler including a plurality of thermocouples connected in series between two poles of a direct current power supply to form a thermopile each said thermocouple consisting of a p-type semiconductor and a n-type semiconductor, a cold junction plate formed at a cold junction of the thermopile and generally vertically formed in a front portion of the housing for cooling air to condense moisture laden in the air when powered by said power supply, and a hot junction plate formed at a hot junction of the thermopile in opposite to the cold junction plate for giving off heat from the hot junction plate;

a heat-dissipating means including: a front thermally conductive panel generally vertically secured in the upper housing portion between the suction hood and the rear chamber, and secured to the hot junction plate of said thermoelectric cooler by a heat conductive layer, and secured in a rear portion of the housing for transferring heat rearwardly from said hot junction plate;

an exhausting fan mounted in a rear end portion of said housing for drafting air to flow through said thermoelectric cooler and said heat-dissipating means for outwardly removing heat therefrom;

a condensate collector including: a water-reservoir drawer slidably held in the bottom socket in the base portion of the housing for collecting the condensate water drained from the thermoelectric cooler, a drain chute inclined downwardly rearwardly from a front end portion of the base portion towards a drainage port formed at a front edge portion of the partition plate adjacent to a rear end of said chute and in between a bottom edge portion of said front thermally conductive panel of the heat-dissipating means and the water-reservoir drawer for draining condensed water into the water-reservoir drawer for disposal purpose, and a check valve secured to a front end portion of the partition plate for normally sealing the drainage port for preventing evaporation of the condensed water already collected in the drawer and operatively opened for gravitationally flowing the condensed water from the chute into the drawer; and a timing controller sequentially alternately switching on and off a power supplied from said power supply to said cooler for intermittently powering the thermoelectric cooler for absorbing heat from the air for condensing moisture laden in the air at the cold junction plate of said cooler and intermittently switching off the power to said cooler to stop cooling on said cold junction plate for draining the condensed water into said condensate collector for disposal purpose.

2. A dehumidifier according to claim 1, wherein said check valve is a thin-layer flap made of elastomer materials normally sealing the drainage port and operatively opening the drainage port for draining condensed water downwardly into said collector; said thin-layer flap resiliently restored after draining the condensed water for re-closing the drainage port.

* * * * *